US007654017B2

(12) United States Patent
Black

(10) Patent No.: US 7,654,017 B2
(45) Date of Patent: Feb. 2, 2010

(54) TRENCHING ATTACHMENT HAVING AN INTERNAL COMBUSTION ENGINE

(76) Inventor: Allan Black, 755 Procupine Blvd., Thunder Bay, ON (CA) P7C 5Y9

( * ) Notice: Subject to any disclaimer, the term of this patent is extended or adjusted under 35 U.S.C. 154(b) by 0 days.

(21) Appl. No.: 12/118,204

(22) Filed: May 9, 2008

(65) Prior Publication Data

US 2009/0277049 A1 Nov. 12, 2009

(51) Int. Cl.
*E02F 5/04* (2006.01)

(52) U.S. Cl. ..... 37/352; 37/403; 37/361; 37/462

(58) Field of Classification Search ..... 37/468, 37/404, 403, 903, 352, 408–410, 361, 386, 37/462

See application file for complete search history.

(56) References Cited

U.S. PATENT DOCUMENTS 1,762,569 A * 6/1930 Barber ..... 37/360
2,698,035 A * 12/1954 Smith, Jr. ..... 83/795
2,710,466 A * 6/1955 Chartier ..... 37/403
2,751,698 A * 6/1956 Brown ..... 37/352
2,817,167 A * 12/1957 Barber ..... 37/352
2,817,911 A * 12/1957 Owen et al. ..... 37/348
2,828,557 A * 4/1958 Brown ..... 37/363
2,835,055 A * 5/1958 Hermes ..... 37/363
2,946,142 A * 7/1960 Swanson ..... 37/347
3,024,546 A * 3/1962 Cramer ..... 37/352
3,057,088 A * 10/1962 George et al. ..... 37/363
3,087,854 A 4/1963 Iwata et al.
3,266,179 A * 8/1966 Golden ..... 37/355
3,302,731 A * 2/1967 Perry ..... 173/112
3,398,471 A * 8/1968 Brown ..... 37/352
3,570,152 A 3/1971 Schuermann et al.
3,603,010 A * 9/1971 Polinek ..... 37/353
3,710,472 A * 1/1973 Gremillion et al. ..... 29/891
3,727,331 A * 4/1973 Hansen ..... 37/403
3,834,049 A * 9/1974 Bond ..... 37/355
3,881,615 A * 5/1975 Albright ..... 414/732
4,159,630 A 7/1979 Schuermann
4,173,836 A * 11/1979 Paurat ..... 37/348
4,199,033 A * 4/1980 Van Gundy, Jr. ..... 173/27
4,322,899 A 4/1982 Clune
D266,765 S 11/1982 Clune
4,660,306 A * 4/1987 Bruce et al. ..... 37/363
4,750,280 A * 6/1988 Dalaine ..... 37/352
4,861,199 A * 8/1989 Hackmack ..... 405/267
4,974,348 A * 12/1990 Wallace ..... 37/465
5,074,063 A * 12/1991 Vannette ..... 37/464
5,161,448 A * 11/1992 Wangsness ..... 83/795
5,419,380 A * 5/1995 Bot ..... 144/334
5,813,151 A * 9/1998 Stephens et al. ..... 37/352

(Continued)

*Primary Examiner*—Thomas A Beach
(74) *Attorney, Agent, or Firm*—Ade & Company Inc.; Kyle R. Satterthwaite; Ryan W. Dupuis

(57) ABSTRACT

A trenching attachment for selective attachment to a working machine features a frame arranged for selective connection to the working machine, an internal combustion engine mounted to the frame and a boom assembly connected to the frame and having a trencher chain installed thereon. The internal combustion engine is operatively connected to the trenching chain to facilitate driving thereof. Having its own dedicated engine, the trenching attachment is less dependent on the power take-off system of the working machine than a conventional trenching attachment that uses a hydraulic motor to power the trencher chain and relies exclusively on delivery of hydraulic fluid from the working machine for operation.

20 Claims, 9 Drawing Sheets

U.S. PATENT DOCUMENTS 6,249,993 B1 * 6/2001 Armstrong et al. ..... 37/361
6,351,900 B1 * 3/2002 DeWind ..... 37/362
6,415,532 B1 * 7/2002 Bricko et al. ..... 37/361
6,435,234 B1 * 8/2002 Paumier ..... 144/24.12
6,516,542 B2 * 2/2003 McClure ..... 37/142.5
6,516,545 B2 * 2/2003 Jenkins, Jr. ..... 37/362
6,658,768 B1 * 12/2003 Bainter ..... 37/352
6,708,430 B2 * 3/2004 Azure et al. ..... 37/361
6,718,661 B1 * 4/2004 Miller ..... 37/403
6,789,336 B2 * 9/2004 Collins et al. ..... 37/352
6,804,903 B1 * 10/2004 Cooper ..... 37/352
6,832,443 B1 12/2004 Piel et al.
6,865,827 B2 * 3/2005 Smith et al. ..... 37/386
7,096,609 B2 * 8/2006 Bainter ..... 37/352
7,186,059 B2 * 3/2007 Barnes ..... 405/175
2002/0112380 A1 * 8/2002 Jenkins, Jr. ..... 37/352
2002/0178622 A1 * 12/2002 Loegering et al. ..... 37/244
2003/0115780 A1 * 6/2003 Azure et al. ..... 37/352
2003/0201107 A1 * 10/2003 Smith et al. ..... 172/540
2007/0134081 A1 * 6/2007 Seabolt ..... 414/723
2007/0220783 A1 9/2007 Hamburger et al.

* cited by examiner 10
16
17
15
14
22
23
52
88
50
66
80
78
68
104
82
84
64
86
38
46
28
32
26
24
30
54
40
90
24a
122
120
124
116
118
44
12
120
124
112
62
64

TRENCHING ATTACHMENT HAVING AN INTERNAL COMBUSTION ENGINE

FIELD OF THE INVENTION

This invention relates generally to trenchers, and more particularly to trenching attachments arranged for selective attachment to a work machine for cooperative use of the work machine and the trenching attachment as a self-propelled trencher.

BACKGROUND OF THE INVENTION

Trenching machines are commonly employed to form a trench or ditch recessed into the ground for the purpose of laying underground pipe or cable that can be subsequently buried by refilling the trench above the laid pipe or cable with the soil or ground material originally removed by such a machine. Conventionally, a trencher uses an endless chain that is equipped with teeth or blades and entrained around a drive sprocket and an idler sprocket carried at opposite ends of a boom arm that is pivotally mounted to a frame of the trencher to swing a distal end of the boom arm upward and downward within a vertical plane. With the chain being driven along the periphery of the boom around the sprockets, the boom is lowered to bring the moving chain teeth into engagement with the ground surface to effectively cut thereinto and dig earth therefrom. The teeth or blades are often shaped to provide a cup or scoop like action that better carries the earth upward out of the ground as the teeth travel along the boom around the sprockets at the opposite ends thereof.

U.S. Pat. Nos. 3,087,854; 3,570,152; 4,159,360; 6,832,443 and U.S. Patent Application Publication Number 2007/0220783 assigned to The Charles Machine Works, Inc. relate to generally to trenching machines, and more particularly relate respectively to a variable speed gear reduction unit for a self-propelled trencher, a crumbing tool for connection to a trenching machine, an assembly for attachment of a tile chute or crumbing tool to the digging boom and mobile chassis of a trenching machine, a cutting chain for a trenching machine and an auger arrangement for a trenching assembly.

U.S. Pat. Nos. D266765 and 4,322,899 assigned to Midmark Corporation relate generally to trenching machines, and more particularly relate respectively to the ornamental design of a self-propelled walk-behind trenching machine and a hydraulic steering mechanism used in a self-propelled non-riding trenching machine.

Trenchers come in a variety of sizes and forms suitable for pipe or cable laying projects of varying scale. Self-propelled trenchers are available in ride-on units of varying sizes and smaller walk-behind units and incorporate drive systems operable to both propel the machine along the ground and drive the trenching or digging chain. Most of the smaller walk-behind units tend to suffer from poor traction relative to their larger ride-on counterparts. Trenching attachments are also available for removable installation on existing self-propelling work equipment of varying sizes, for example various tractors, loaders, walk behind or ride-on skid steers and other working machines. For example, a trenching attachment installed on a walk-behind skid steer may provide improved traction relative to a stand-alone walk-behind trencher. However, a conventional trenching attachment typically relies on a power take-off system of the vehicle or working machine on which it is installed to power its trenching or digging chain, and thus is limited in performance by the capabilities of this system. For example, the auxiliary hydraulic system of a walk behind mini-skid steer may not be capable of providing as much digging power to an attachment carried on the skid steer as could be produced using a stand-alone walk-behind gas-powered trencher.

SUMMARY OF THE INVENTION

According to a first aspect of the invention there is provided a trenching attachment for selective attachment to a working machine, the trenching attachment comprising:

a frame arranged for selective connection to the working machine;

an internal combustion engine mounted to the frame; and a boom assembly connected to the frame and having a trencher chain installed thereon;

the internal combustion engine being operatively connected to the trenching chain to facilitate driving thereof.

Having its own dedicated engine, the trenching attachment is less dependent on the power take-off system of the working machine than a conventional trenching attachment that uses a hydraulic motor to power the trencher chain and relies exclusively on delivery of hydraulic fluid from the working machine for operation. In such a prior art arrangement, the capabilities of a particular working machine's hydraulic power take-off system limits the size of the hydraulic motor of a trenching attachment usable therewith, which in turn limits the size of the trenching boom that can be effectively powered for trenching operations. The digging chain entrained around the boom of a trencher attachment of the present invention, however, relies on the attachment's own dedicated engine for power, thus allowing an attachment of increased boom size to be produced for the same working machine by using a correspondingly larger engine on the attachment. At the same time, the use of the attachment in combination with a working machine benefits from improved traction provided by the working machine relative to a stand-alone walk behind trencher having a similarly sized boom and chain.

The internal combustion engine may comprise a gas-driven motor.

Preferably there is provided an actuator carried on the frame and operable to effect raising and lowering of the boom assembly relative thereto, the actuator being arranged for selective connection to the working machine for powering thereby.

The actuator may comprise a hydraulic cylinder arranged for selective connection to the working machine to receive pumped hydraulic fluid therefrom.

Preferably there is provided a clutch assembly carried on the frame and operable to selectively and disengage a connection between the boom assembly and a driveshaft rotatable by the engine to control operation of the trenching chain.

The frame of the attachment may be free of any ground engaging elements depending downward therefrom and operable to facilitate rolling of the attachment over a ground surface.

Preferably there is provided a control mechanism connected to the internal combustion engine and operable from a distance from the engine to effect control thereover.

Preferably the control mechanism comprises an electric starter carried on the frame and coupled with the engine and a starter switch connected to the electric starter and operable to provide electrical power thereto.

The control mechanism may comprise a manually operable control device carried on a flexible cord movable relative to the engine fixed to the frame.

According to a second aspect of the invention there is provided, in combination, a self-propelled work machine and a trenching attachment, the trenching attachment comprising:

a frame releasably attachable to the work machine for movement therewith along a ground surface;

an internal combustion engine mounted to the frame; and a boom assembly connected to the frame and having a trencher chain installed thereon;

the internal combustion engine being coupled to the trenching chain to facilitate driving thereof.

The attachment preferably comprises an actuator carried on the frame and operable to effect raising and lowering of the boom assembly relative thereto.

Preferably the actuator is releasably connectable to a power take-off system of the working machine for selective powering thereby. The actuator may comprise a hydraulic actuator connectable to a hydraulic system of the working machine to receive pumped hydraulic fluid therefrom.

Preferably the attachment comprises a control mechanism connected to the internal combustion engine and operable from an operator panel of the work machine.

Preferably the control mechanism comprises an electric starter carried on the frame and coupled with the engine and a starter switch connected to the electric starter and operable from the operator panel of the work machine to provide electrical power to the electric starter.

The control mechanism may comprise a manually operable control device releasably mounted to the work machine proximate the control panel thereof and connected to the attachment by a flexible cord.

Preferably the trenching chain is powered solely by the internal combustion engine of the attachment, which preferably is operable to drive the trenching chain independently of any and all powering systems of the work machine.

BRIEF DESCRIPTION OF THE DRAWINGS

In the accompanying drawings, which illustrate an exemplary embodiment of the present invention.

DETAILED DESCRIPTION

Figure 1:
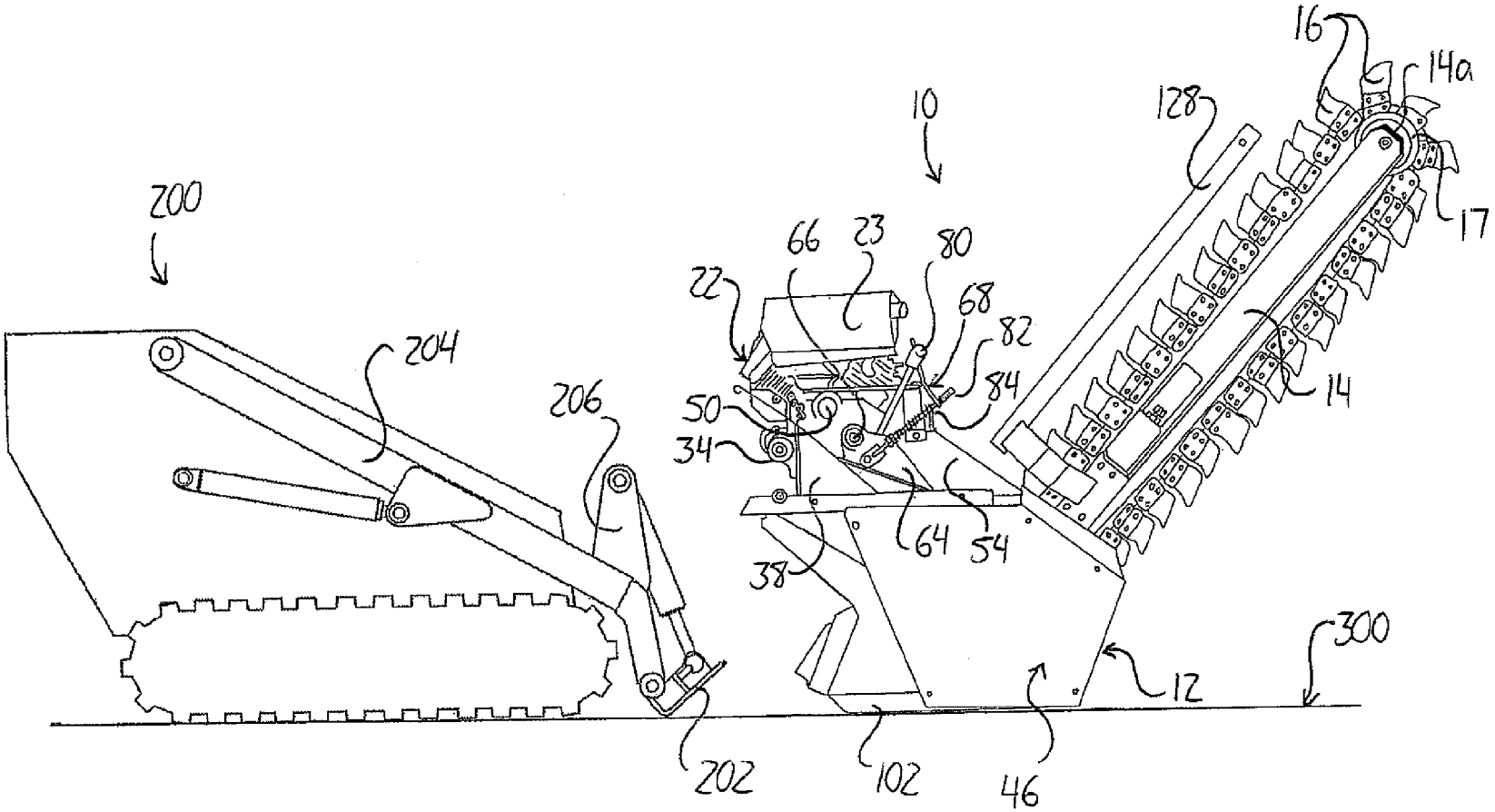
FIG. 1 is a side elevational view of a skid steer and a trenching attachment therefore.
Figure 7:
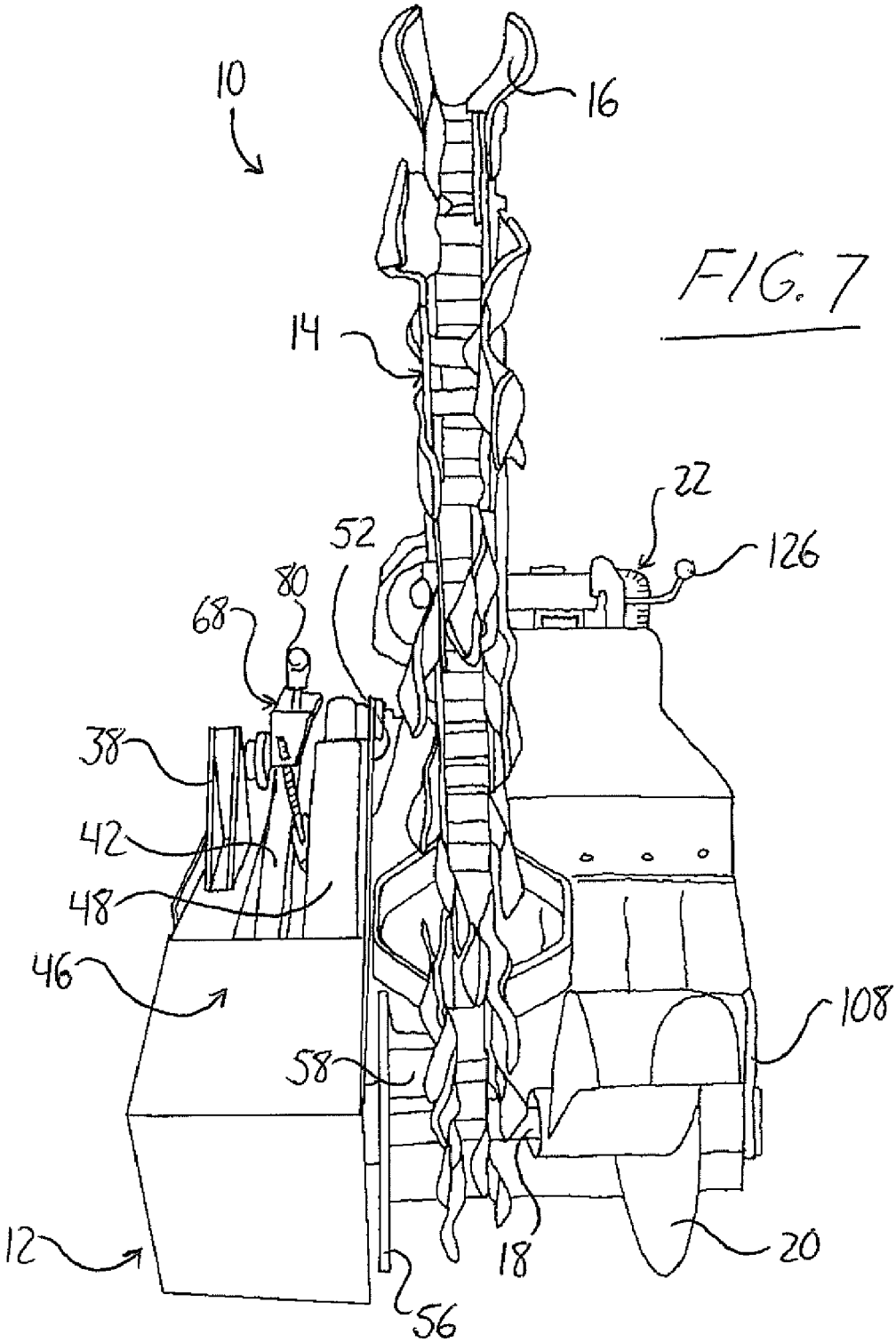
FIG. 7 is a front elevational view of the trenching attachment.

FIG. 1 shows a trenching attachment 10 adapted for removable mounting on the lift arms of an existing conventional walk-behind skid steer 200. The trenching attachment 10 feature a rigid frame 12 on which a boom arm 14 is pivotally mounted to facilitate swinging of a distal end 14*a* of the boom arm opposite the connection thereof to the frame 12 within a vertical plane with the frame 12 resting on a horizontal ground surface 300. An endless trenching or digging chain 15 featuring a plurality of cutting or digging blades or teeth 16 projecting outward therefrom is entrained about an idler sprocket 17 mounted for rotation about a horizontal axis at the distal end 14*a* of the boom arm 14 and about a drive sprocket mounted proximate the opposite end of the boom arm 14 connected to the frame 12 for rotation about a respective horizontal axis. As seen in FIG. 7, the mounting of the boom 14 at a front end of the attachment 10 is of a conventional structure known to those of skill in the art, with a rotatable driven shaft 18 horizontally traversing the frame 12 defining the pivot axis of the boom 14 and the rotational axis of the drive sprocket. To one side of the boom 14, auger flighting 20 is fixed to the driven shaft 18 for rotation therewith to displace earth or soil carried upward from the ground by the trenching chain 15 laterally away from the boom 14 to a respective side of the attachment frame 12. However, unlike prior art trenching attachments relying entirely on a power take-off system of the skid steer 200 to power rotation of the chain 15 about the sprockets along the periphery of the boom arm 14, the trenching attachment 10 features its own dedicated internal combustion engine 22 carried atop the frame 12 to drive the trenching chain 15.

Figure 4:
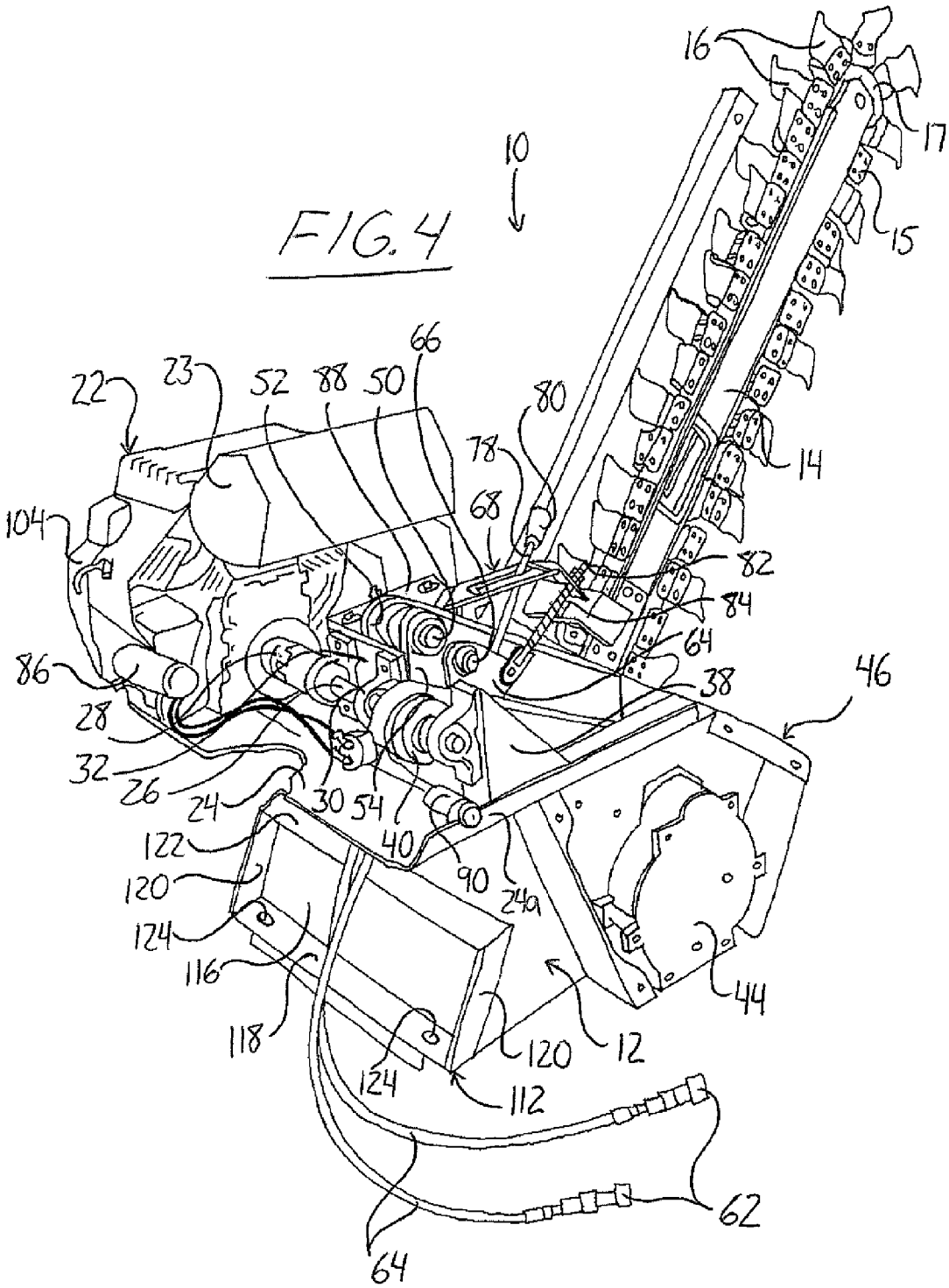
FIG. 4 is a perspective view of the trenching attachment.

As shown in FIG. 4, the engine 22 and its muffler 23 carried thereon are mounted atop the frame 12 on a horizontally oriented support plate 24 thereof, offset to one side of a central vertical plane of the attachment 10 in which the boom arm 14 extends. At a side of the engine 22 nearest and facing this central vertical plane at a distance above the support plate 24, a horizontal output shaft of the engine 22 is connected to a driveshaft 26 parallel and coaxial thereto by a coupler 28. The driveshaft 26 is rotatably supported by a pair of equally sized pillow block bearings 30 flush mounted on a vertical mounting plate 32 projecting perpendicularly upward from the support plate 24 in a direction perpendicular to the central vertical plane to extend rearward therefrom away from the front end of the attachment at which the boom 14 is carried to support the driveshaft 26. The linear extending driveshaft 26 extends away from the engine 22 past the pair of pillow block bearings 30 to a third pillow block bearing 34 of equal size spaced therefrom. The third pillow block bearing 34, mounted in the same orientation as and in axial alignment with the pair of pillow block bearings 30, is mounted on a rearward facing vertical surface 36 defined by the thickness of a wedge or triangular-shaped bearing support or stability tower 38 forming a right-angle bracket projecting upward from the horizontal support plate 24 along a side edge thereof parallel to the central vertical plane and opposite the engine 22.

Between the pair of pillow block bearings 30 and the third pillow block bearing 34, an input drive sheave or pulley 40 is fixed concentrically on the driveshaft 26 for rotation therewith when the engine 22 is running. A drive belt 42 is entrained about the input drive sheave 40 and extends downward and forward therefrom to entrain about a corresponding output driven sheave coupled concentrically to an input drive gear of a gear train for rotation therewith, the driven sheave and the input gear being schematically shown in FIG. 3 at 39 and 41*a* respectively. A driven output gear of the gear train is mounted concentrically on the driven shaft 18 to drive rotation thereof, which in turn drives operation of the trenching or digging chain 15 by way of the drive sprocket fixed concentrically on the driven shaft 18 at the connection end of the boom arm 14. the output gear and the drive sprocket being schematically shown in FIG. 3 at 41*b* and 42 respectively. The gear train is used in a known manner to provide gear reduction, establishing a lower rotational speed at the driven shaft 18 than provided at the driveshaft 26 by the engine 22. In other words, between the drive pulley 40 and the drive sprocket fixed on the shaft is a gearbox interface that in a known manner manipulates the rotation of the motor output rpm to a much lower speed, high torque curve that allows for the maximum aggressive chain action. The rotational direction imparted by the engine 22 on the driveshaft 26 and the gear train configuration are selected in a manner known to those of skill in the art to cooperate to provide the desired rotational direction of the driven shaft 18, suitable to drive the trenching chain 15 outward away from the frame 12 toward the distal end 14*a* of the boom arm 14 along the upper side thereof and back toward the frame along the boom arm's lower side.

Figure 3:
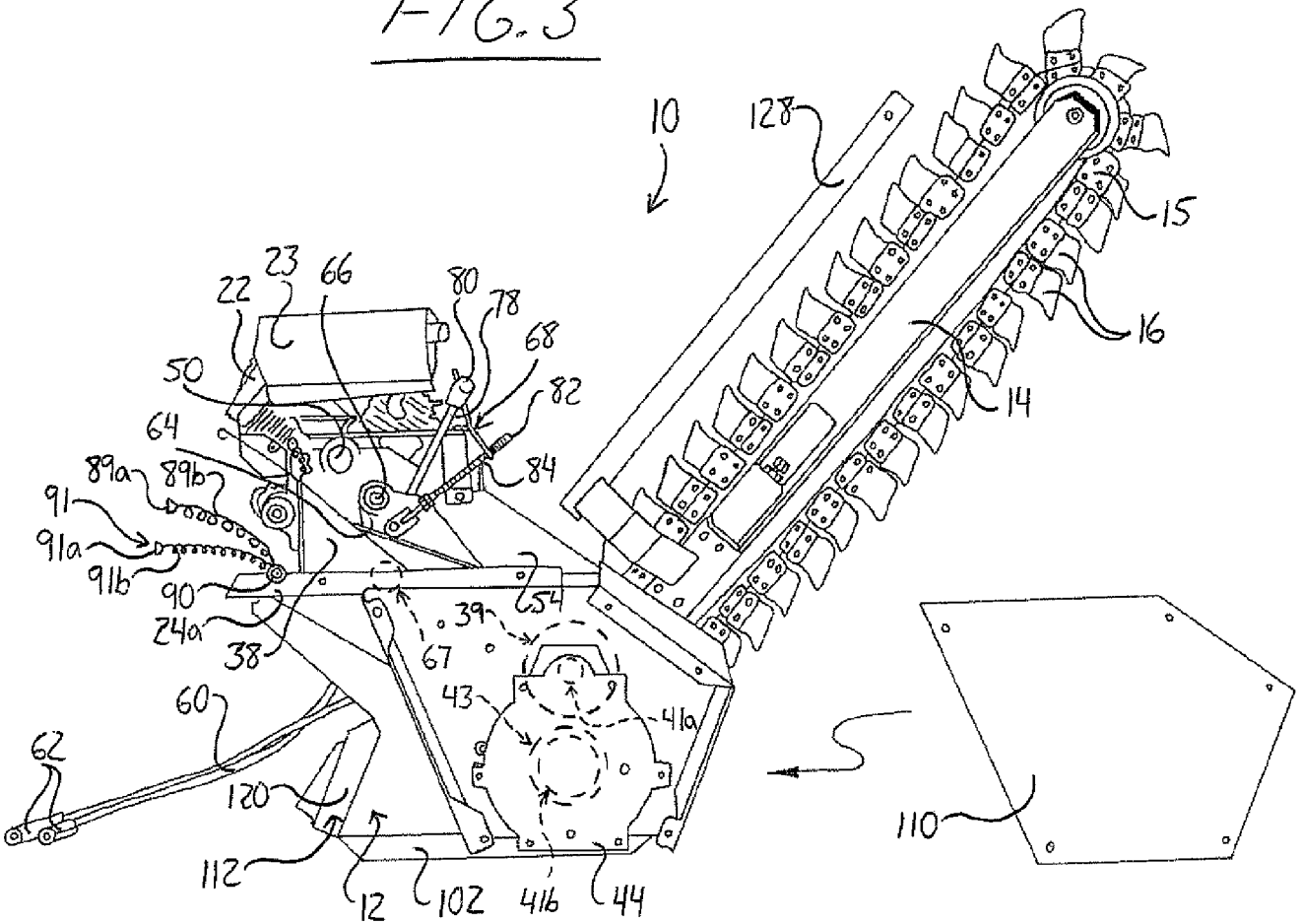
FIG. 3 is a side elevational view of the trenching attachment with a side cover panel thereof removed for illustration.

As shown in FIGS. 3 and 4, the gear train is housed within a gear box or casing 44 located below the horizontal support plate 24 proximate the front end of the attachment frame 12 at the same side edge of the support plate 24 as the wedge-shaped bearing support 38. With reference to FIGS. 4 and 7, an input shaft of the gear train on which the driven sheave and input drive gear are fixed and the driven shaft 18 on which the driven output gear is fixed project horizontally from the gear casing 44 in a direction traversing the attachment frame 12 and normal to the central vertical plane thereof into a hollow front compartment 46 of the frame 12 positioned between the gear casing 44 and the boom 14 forward of the pillow block bearings 30, 34. A top end of this compartment 46 is left open by a cut away or absent portion of the support plate 24 inward from the side edge thereof at which the bearing support 38 is mounted. It is through this open top of the hollow front compartment 46 that the drive belt 42 slopes downward and forward from the drive sheave 40 for connection to the driven sheave within this hollow compartment 46 below the support plate 24 to drive the input gear of the gear train.

Also sloping downward and forward through the open top of the hollow front compartment 46 of the frame 12 from above the support plate 24 is an actuator in the form of a hydraulic cylinder 48 connected to the boom 14 in a known manner so as to be operable to effect pivotal motion thereof about the driven shaft 18 to raise and lower the boom's distal end 14*a* relative to the ground surface into which the trenching attachment 10 is intended to dig. With reference to FIGS. 4 and 7, the cylinder 48 has its upper end fitted about a horizontally extending pivot pin 50 that is parallel to the driveshaft 26 and the driven shaft 18 and mounted to extend between two vertical lift channel side walls 52, 54 parallel to the central vertical plane of the frame 12 on opposite sides of the cylinder 48. The vertical mounting plate 32 on which the first pair of pillow block bearings 30 are mounted extends across these two side walls 52, 54 at their rear edges, the cylinder's pivot pin 50 being situated just above and forward of the vertical mounting plate 32 proximate upper rear corners of the side walls 52, 54. These two side walls 52, 54 situated between the drive belt 42 and the engine 12 at the hollow front compartment 46 of the frame 12 depend partially downward thereinto to define a lift channel or portion of this compartment in which the hydraulic cylinder 48 is free to move without interference from other components to effect lifting and lowering of the boom 14. An inner one 52 of these side walls nearest the engine 22 is situated at an inner side boundary of the hollow front compartment 46 facing and nearest the boom 14.

Within the hollow front compartment 26 of the frame 12, a lower end of the hydraulic cylinder 48 is connected to a pivot assembly fitted about, but not fixed to, the driven shaft 18 with a bushing provided between the pivot assembly and the driven shaft 18 to allow relative pivoting therebetween about the driven shaft's horizontal axis normal to the central vertical plane of the frame 12 in which the boom 14 pivots. In other words, the pivot assembly is carried on the drive shaft 18, but not fixed thereto for rotation therewith. A central portion of the pivot assembly is defined by a circular disc plate 56 projecting radially outward away from the driven shaft 18 and positioned just outside the hollow front compartment 46 past the inner side wall 52 between the cylinder 48 and the boom 14, as shown in FIG. 7. A connection pin is carried on the disc plate 56 to project away therefrom on the side thereof facing the hollow compartment 46 of the frame in an orientation parallel to the driven shaft 18 at a position radially outward therefrom. Within the hollow front compartment 26, the lower end of the hydraulic cylinder 48 is connected to this connection pin and pivotal about the horizontal axis defined thereby so that extending and contracting of the hydraulic cylinder relative to the fixed position of the pivot pin 50 at its upper end moves the connection pin of the pivot assembly along an arcuate path about the driven shaft 18 to effect rotation of the pivot assembly's disc plate 56 about the driven shaft axis. A first leg of an L-shaped connection arm 58 projects parallel to the driven shaft 18 from the side of the disc plate 56 facing the boom 14. A second leg (not shown) of the connection arm 58 extends from the first arm at a right angle thereto at an end thereof opposite the disc plate 56 so as to project radially away from the driven shaft further than the disc plate 56. The second leg of the connection arm 58 is concentrically received in a hollow interior of the boom arm 14 through an opening in the end thereof nearest, but radially spaced from, the driven shaft 18 so that the boom arm 14 is carried on the pivot assembly by the connection arm 58. The digging chain 15 is entrained about the idler sprocket rotatably carried at the distal end 14*a* of the boom arm 14 and the drive sprocket, which is fixed to the driven shaft 18 for rotation therewith at a position therealong aligned with the boom arm 14 radially inward from the corner defined at the intersection of the first and second legs of the L-shaped connection arm 58. As a result of this arrangement, operation of the hydraulic cylinder 48 to pivot the pivot assembly about the axis of the driven shaft 18 also swings the boom 14 about the same axis to control raising and lowering of the boom 14 and the digging chain 15 thereon. As shown in FIGS. 3 to 6, the attachment features hydraulic fluid delivery lines 60 connected to the hydraulic cylinder 48 for operation thereof and featuring quick connectors 62 arranged for releasable attachment to mating connectors included on the skid steer 200 in a conventional manner as part of an auxiliary hydraulic system thereof.

Figure 8:
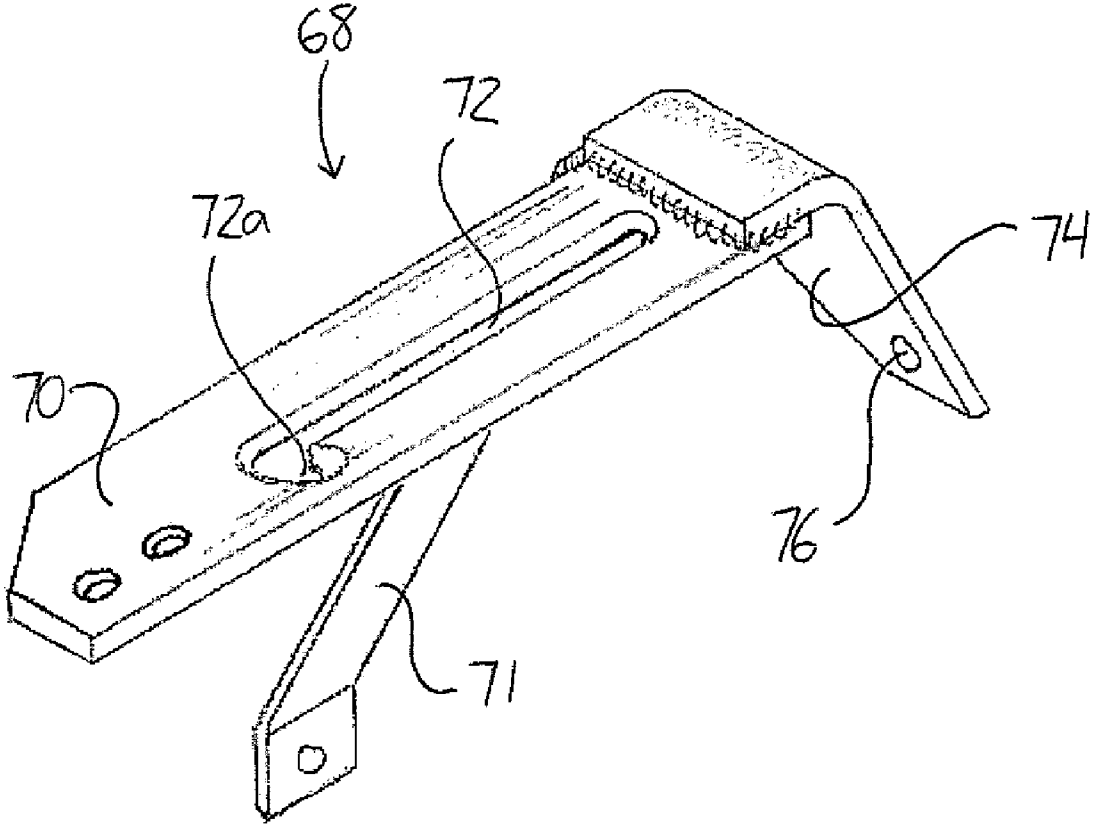
FIG. 8 is a perspective view of a clutch lever bracket of the trenching attachment.

The attachment 10 features a drive belt tension clutch operable to engage and disengage the operable connection provided between the driveshaft 26 and driven shaft 18 by the drive belt 42. The clutch assembly features a pivot plate 64 pivotally mounted on an outer one 54 of the two lift channel side walls opposite the engine 22. The pivot plate is parallel to the outer side wall 54, positioned between the drive belt 42 and the outer side wall 54 and is pivotally connected to this outer side walls 54 for pivotal motion about an axis normal thereto. The pivot plate 64 depends downward from its pivotal connection 66 to the outer side wall 54 through the open top end of the hollow front compartment 46 of the frame 12 to carry an idler sheave or pulley positioned about a horizontal axis parallel to the driveshaft 26 and driven shaft 18 within the front compartment in alignment with the drive belt 42, the idler sheave being schematically shown in FIG. 3 at 67. A clutch control bracket 68 is rigidly mounted in a fixed position over the pivot plate 64. With reference to FIGS. 1, 3 and 8, the clutch control bracket 68 features a flat elongate plate portion 70 oriented horizontally with its longitudinal dimension extending parallel to the central vertical plane of the frame 12 over the pivot plate 64. A support arm 71 depends downward from the elongate plate portion 70 at an oblique angle thereto, sloping toward the outer side wall 54 of the lift channel and fixed thereto to support the clutch control bracket 68. An elongated slot 72 is formed in the elongate plate portion 70, extending along its longitudinal dimension parallel to the central vertical plane of the frame 12. At a forward end of the elongate plate portion 70 nearest the boom 14 at the front end of the attachment 10, an angled portion 74 of the bracket 68 slopes obliquely downward from the elongate plate portion 70 along the longitudinal dimension thereof. A through hole 76 is formed in this angle portion 74 of the bracket 68 proximate the lowermost and forwardmost end thereof.

With reference to FIGS. 1, 3 and 4, a clutch lever 78 has a lower end thereof fixed to the pivot plate 64 at a distance from the pivot point so that pushing or pulling of the lever 78 will cause the pivot plate 64 to pivot about its pivot point 66. The lever extends upward from the pivot plate 64, passing through the elongate slot 72 in the elongate plate portion 70 of the clutch control bracket 68 to support a knob 80 atop the lever above the bracket 68. The rigidly mounted bracket 68 thus limits pivoting of the pivot plate 64 within a predetermined range by blocking motion past the closed ends of the elongate slot 72. A rod 82 has a lower end thereof pivotally connected to the pivot plate 64 to allow pivoting of the rod 82 about an axis parallel to and spaced from the pivot axis of the pivot plate 64. The rod 82 passes through the hole 76 in the angled portion 74 of the clutch control bracket 68 and has a compression spring 84 coiled around the rod 82 between the angled portion 74 of the bracket 68 and a stop collar provided on the rod 82 on the same side of the angled portion of the bracket 68 as the rod's connection to the pivot plate 64. The diameter of the through hole 76 in the bracket 68 and the outer diameter of the stop collar on the rod 82 are respectively smaller and larger than the diameter of the spring coils so as to retain the spring between the stop collar and the angled portion 74 of the bracket 68.

Figure 2:
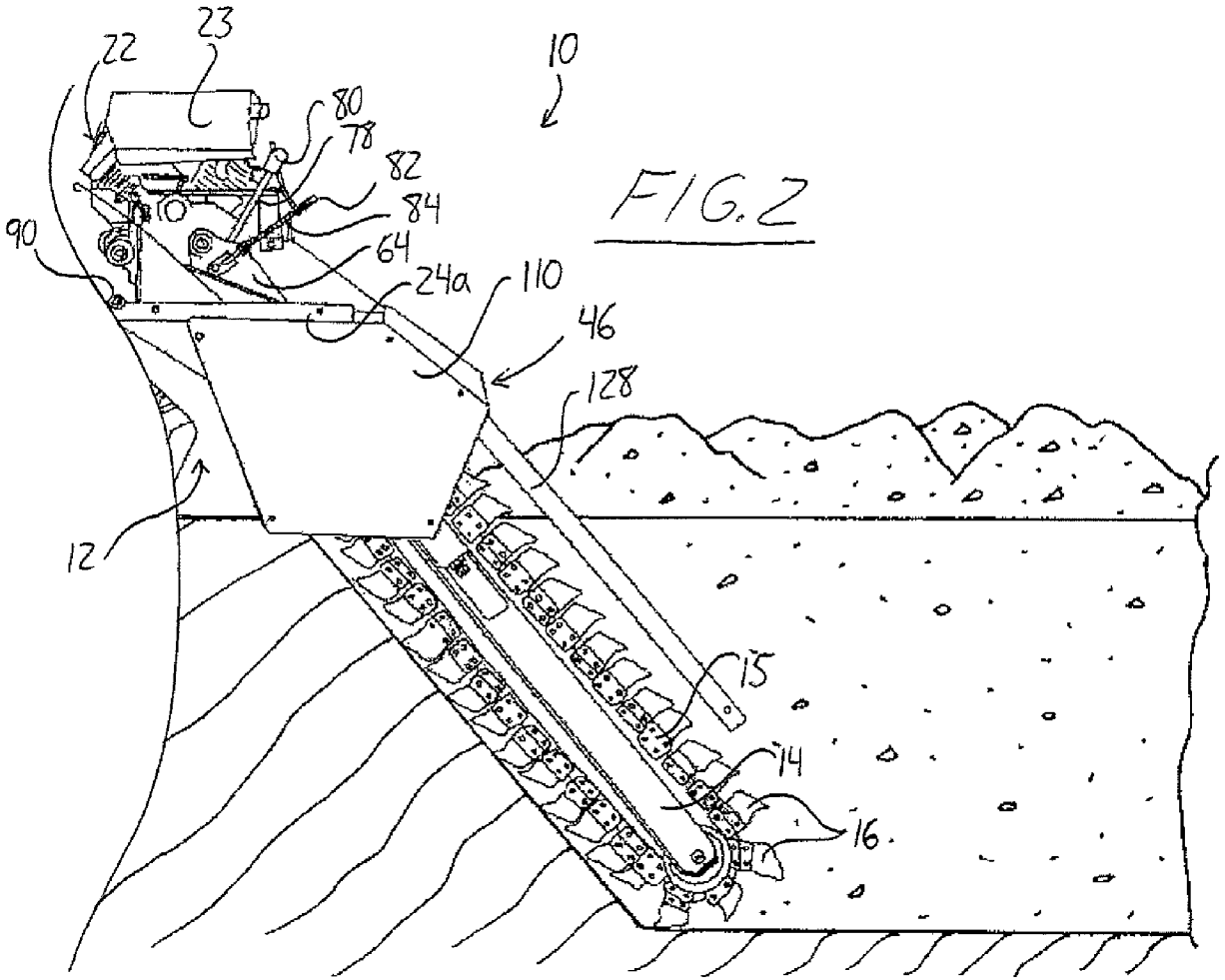
FIG. 2 is a partial side elevational of the trenching attachment during use thereof of the skid steer.

With references to FIGS. 1 to 4, the clutch lever 78 is biased into disengage position at the fowardmost end of the elongate slot 72 in the clutch control bracket 68 by the spring 84. With the clutch in this disengaged condition, the rod 82 connects to the pivot plate 64 forward of and below the pivot axis thereof, the spring's compression-resisting expansion tendency acting against the fixed bracket 68 and the stop collar carried on the movable pivot plate 64 by the rod thus tending to move the connection point of the rod 82 and pivot plate 64 downward and rearward, in other words encouraging clockwise rotation of the pivot plate when viewed from the side of the attachment 10 opposite the engine 22 as shown in FIGS. 1 to 3. Pivoting of the pivot plate beyond this disengaged position in this direction is prevented by engagement of the clutch lever 78 against the forwardmost end of the clutch control bracket's elongate slot 72. In this disengaged condition of the clutch assembly, the idler sheathe carried on the pivot plate below the support plate 24 in the hollow front compartment 46 of the frame 12 is not in contact with the drive belt 42, resulting in a relatively slack condition of the drive belt 42 about the drive sheave 40 and the output driven sheave fixed to the input gear of the gear train. In this condition, the slack in the belt is sufficient to allow slip between the belt and the drive sheave 40 so that the belt is not driven despite operation of the engine 22 to rotate the driveshaft 26.

To engage the clutch, the clutch lever 78 is pulled rearward from the disengaged position, pivoting the pivot plate 64 against the bias of the compression spring in a counter-clockwise direction when viewed from the side of the attachment opposite the engine 22 to a rearwardmost end of the slot 72 in the clutch control bracket 68 opposite the boom 14. As shown in FIG. 8, this end of the otherwise linear slot 72 features a notch 72*a* projecting laterally therefrom, into which the clutch lever 78 can be shifted out of the linear portion of the slot 70 to prevent sliding of the lever back therealong to the disengaged position under the bias of the spring 84. The pivoting of the pivot plate 64 under this pulling of the clutch lever 78 rearward moves the idler sheave upward into engagement with the drive belt 42 at a point therealong between the drive sheave 40 and the driven sheave coupled to the input drive gear of the gear train, pushing the belt at this point of engagement to tension the belt around the drive sheave and driven sheave so that the belt is driven by the drive sheave 40 under rotation of the driveshaft 26 by the engine 22. As a result of this arrangement, the clutch is biased into a disengaged state where the belt tension is sufficient to retain the drive belt's position about the drive sheave and driven sheave, but is not sufficient to transfer rotational motion between them. The default condition of the attachment, even with the engine 22 running, is thus a state in which the digging chain 15 is not being driven.

Figure 6:
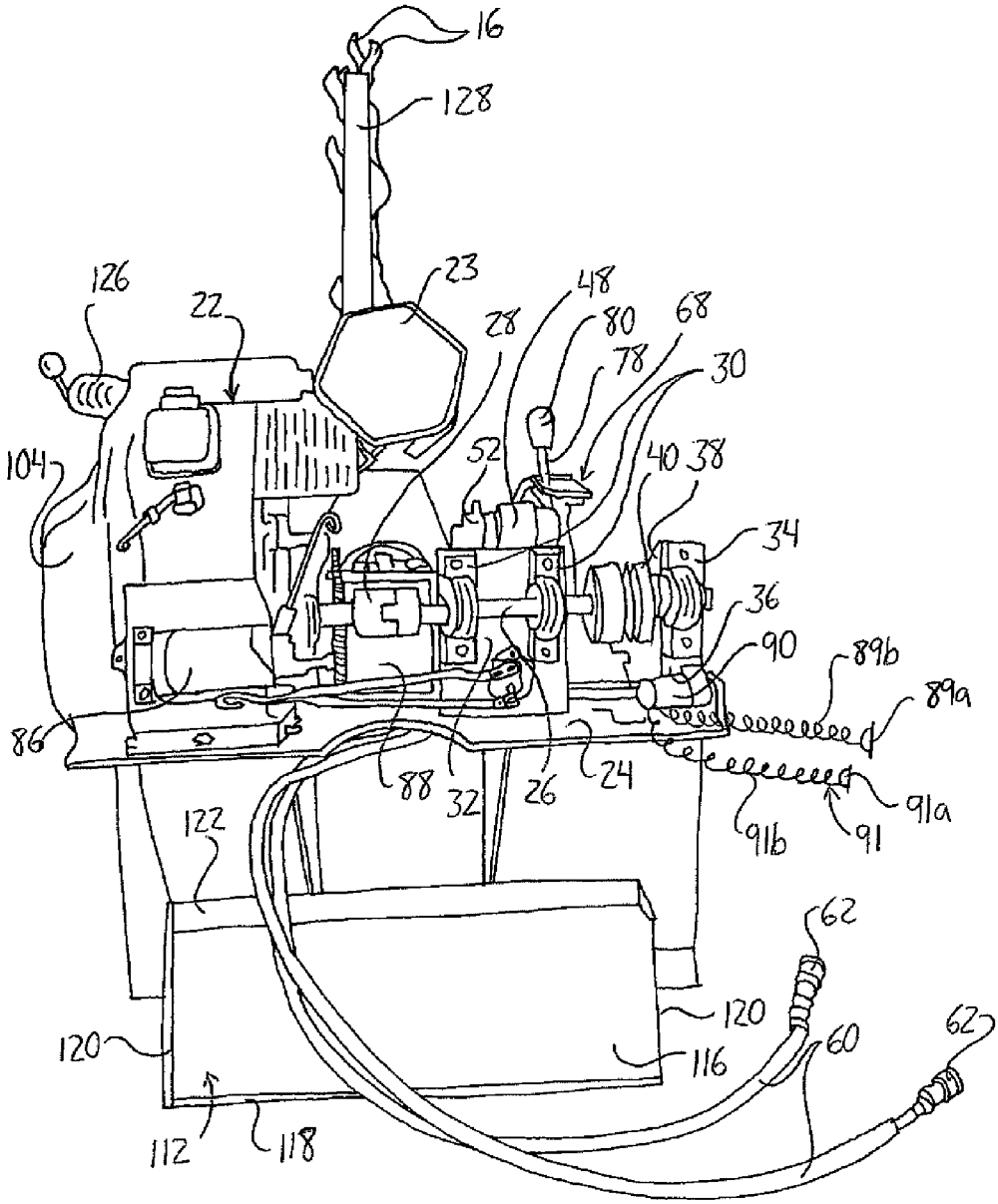
FIG. 6 is a rear elevational view of the trenching attachment.

With reference to FIGS. 4 and 6, to facilitate easy starting of the engine 22, an electric starter 86 is installed thereon in a known manner. A battery 88 connected to a charging system of the engine 22 is mounted atop the support plate 24 between the inner side wall 52 of the lift channel and the engine 22 to provide power to electric starter. A key switch 90 is mounted to the frame atop the support plate 24 and, in a known manner, is wired to the electric starter 86, the battery 88 and a magneto of the engine 22 so that in the absence of a machine-specific key, the starter will not operate and the gasoline engine cannot carry out combustion due to a lack of spark achieved by grounding the magneto-sparkplug circuit. In the illustrated embodiment, the support plate 24 features an upturned flange 24*a* extending fully along the side edge at which the bearing support 38 and key switch 90 are generally mounted. As shown in FIGS. 3 and 6, the attachment may also feature a remote starter control 91 wired with the key switch 90 and electric starter 86 to facilitate remote starting of the engine 22 at a distance from the engine and the frame 12 to which the engine 22 is fixed. As shown, the starter control 91 may use a starter switch 91*a* connected to the rest of the starting circuit by way of a flexible cable 91*b* containing the necessary wiring. The flexible cable or cord may be provided in sufficient length to facilitate positioning or mounting of the starter switch at a control panel of the skid steer 200. A kill switch or dead man's switch 89*a* may also be wired to the magneto in a known manner through such a flexible cable or cord 89*b* for use of the switch at the position from which the operator controls the working machine to improve safety by enabling quick shut down of the engine in potentially dangerous situations by cutting off power to the motor when the operator releases the dead man's switch, as this lack of input from the operator may indicated that he or she has been incapacitated.

Figure 9:
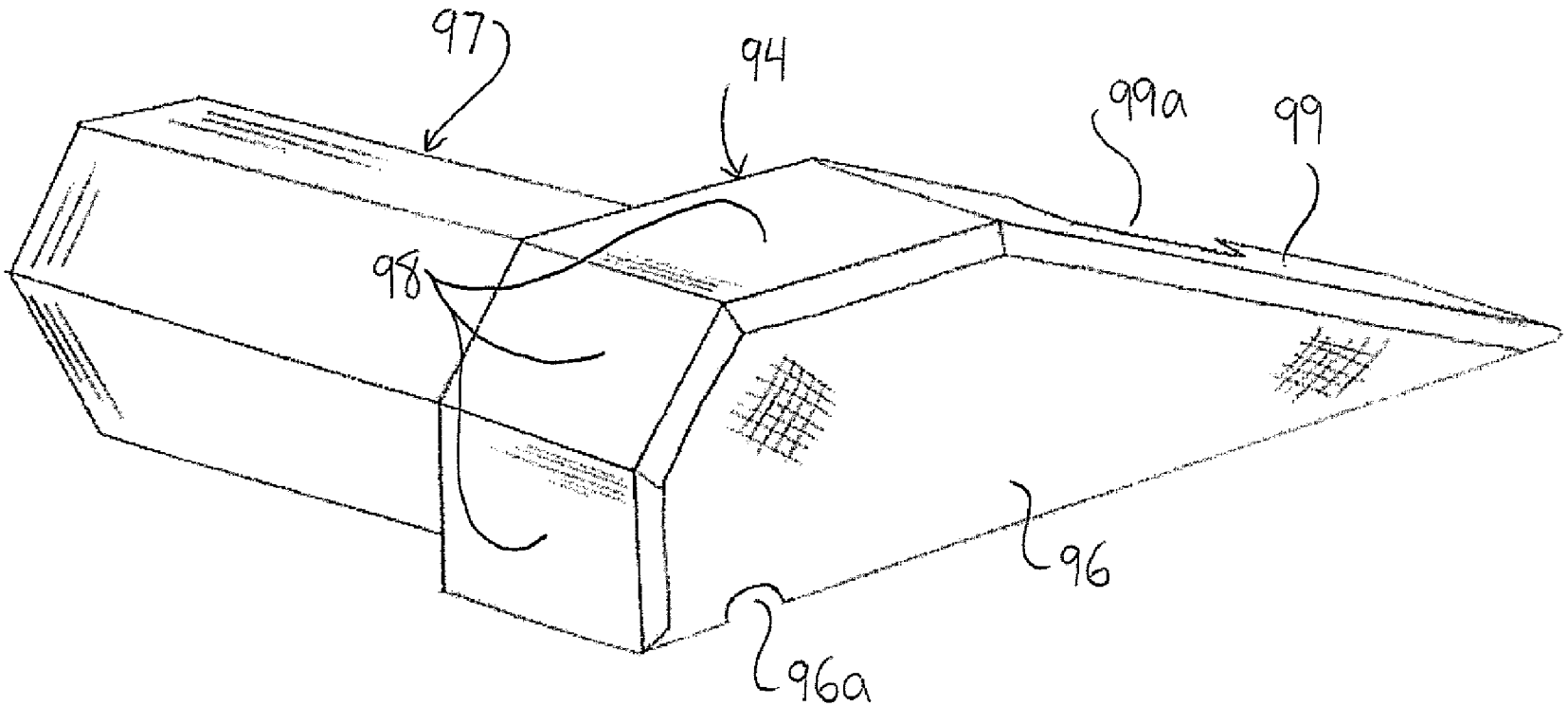
FIG. 9 is a perspective view of a top cover body of the trenching attachment, removed from FIGS. 1 to 8 for illustration.

FIG. 9 shows a cover 92 shaped to fasten in place on the frame 12 to fit over the drive belt 42, bearing support 38, drive sheave 40, key switch 90 and driveshaft 26. The cover features a first body 94 having a straight vertical side 96 that extends along the respective side of the support plate 24 just inside or outside the upturned flange 24*a*. A rear portion of the first body 94 features three generally rectangular panels 98 resembling three adjacent sides of an octagonal cylinder, that when installed on the attachment extend first vertically upward proximate a rear edge of the support plate 24, then obliquely upward and forward and finally horizontally forward over the rearward facing vertical surface 36 of the bearing support 38. The first body 94 is of a sufficient width, measured in the transverse direction of the attachment normal to the central vertical plane, such that these three sections 98 cover the bearing support 38 and the drive sheave 40. Forward from the top horizontal one of these three sections 98, the top of the first body 94 slopes linearly downward and forward to cover the drive belt 42 sloping downward and forward at an equal or similar angle into the open top of the hollow front compartment 46 of the frame 12. This sloped top front panel 99 of the first body 94, having the same width as the rest of thereof, spans from the vertical side 96 to the outer lift channel side wall 54, except at a notch 99*a* extending into the top front panel 99 from the edge thereof opposite the vertical side 96 over a portion of the top front panel's length to allow the clutch lever 78 and spring rod 82, 84 to project upward from the clutch pivot plate 64 through the notch 99*a* between the outer lift channel side wall 54 and the top front panel 99 of the cover's first body 94. The notch extends along the top front panel 99 a sufficient distance to accommodate movement of the clutch lever 78 between the engaged and disengaged positions.

In the illustrated embodiment, the vertical side 96 of the first body 94 is formed of a screen or mesh material to allow airflow therethrough and features a recess 96*a* extending into it from its bottom edge proximate the rear of the body to accommodate an upper half of the key switch body having its lower half similarly recessed into the upturned flange 24*a* of the support plate 24 from the top edge thereof. The key switch thus either projects or is accessible through the opening defined by cooperation of the aligned recesses in the frame's upturned flange 24*a* and the cover's side panel 96 with the cover installed. A second body 97 of the cover 92 has a similar multi-sided configuration as the rear portion of the first body 94 and projects laterally therefrom in a direction normal to the vertical side 96. The second body 97 is open at the forward facing side thereof, covering the pair of pillow block bearings 30 and the section of the driveshaft 26 between them from above and behind. The second body 97 is open at both ends to accommodate the driveshaft 26 passing fully therethrough.

Figure 5:
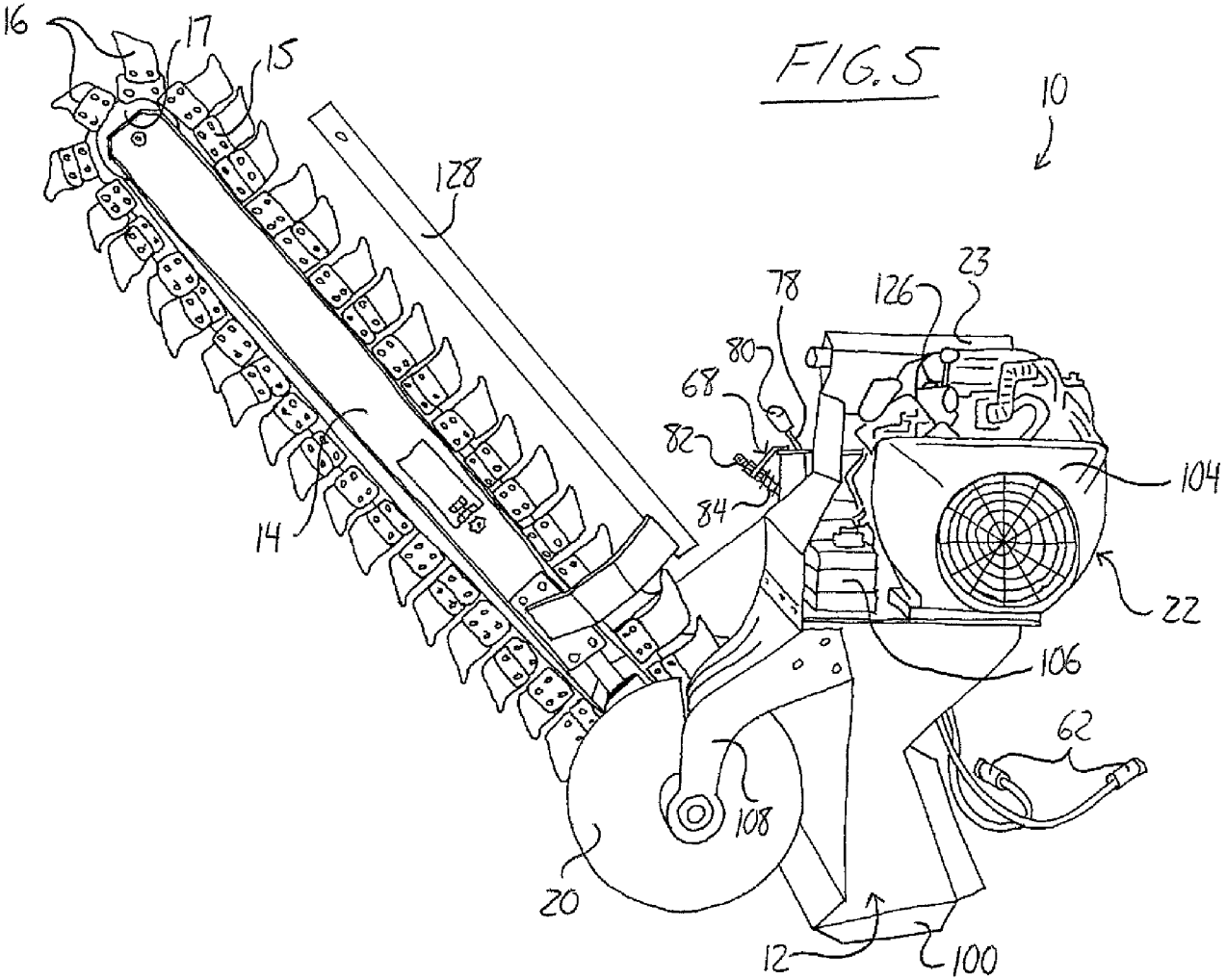
FIG. 5 is a side elevational view of the trenching attachment opposite the side elevational view of FIG. 3.

The bottom of the frame 12 features a pair of elongate skids 100, 102 fixed thereto to extend parallel to the central vertical plane at or adjacent opposite sides of the frame 12 so that the trenching attachment 10 only engages the ground at these relatively narrow skids rather than over the full width of the attachment. The illustrated embodiment thus uses no moving parts or roller elements, such as wheels or tracks, to engage the ground for movement thereover, instead relying solely on a sliding movement of the attachment via face-to-face contact between the ground and the skids fixed to the frame to depend downward therefrom. As shown by comparison of FIG. 5 with FIG. 31 the skid 100 on the engine side of the frame 12 is significantly shorter than the skid 102 on the opposite gear casing side of the frame 12, as the engine side of the frame is only long enough to mount the motor 104 and fuel tank 106 of the engine 22 atop the support plate 24 while the gear casing side of the frame 12 has a greater length created by the hollow front portion 46 projecting forward from the rest of the frame 12. With reference to FIG. 5, a support arm or bracket 108 extends forward and downward from immediately beneath a front edge of the support plate 24 at the engine side of the frame 12 to rotatably support a respective end of the driven shaft 18 to a side of the auger flighting 20 opposite the boom 14. As shown in FIG. 3, the frame features a removable side panel 110 at the side of the hollow front compartment 46 opposite the boom 14 that can be removed to access fill and drain plugs of the gear casing 44 housing the reduction gear train for the driven shaft 18 at the front end or head of the attachment 10.

As shown in FIGS. 3 and 4, the frame has a mounting unit 112 of a known type fixed to an upward and rearward facing panel of the frame 12 above the skids at the bottom of the frame 12 at the rear end of frame bottom. The mounting unit 112 features a flat rectangular base plate 116 fastened face-to-face with and flush against the sloped panel extending obliquely upward and forward from the frame bottom. Bottom and side perimeter walls or flanges 118, 120 project perpendicularly rearward from the base plate 116 along respective edges thereof at the bottom and sides of the frame 12. A top perimeter wall or flange 122 also projects rearward from the base plate 116, but at an oblique angle of approximately forty-five degrees thereto, projecting rearward and downward. The bottom perimeter wall 118 has a pair of through holes 124 therein, each proximate but inward from a respective one of the side walls 120. This mounting unit 112 is arranged for selective coupling with a known type of skid steer mounting plate 202 featured at the distal end of the skid steer's lift arms 204. In use, the lift arms 204 are operated to insert an upper edge of the skid steer mounting plate 202 upward into the space between the mounting unit's base plate 116 and the sloped top perimeter wall 122 and subsequently move the rest of the skid steer mounting plate 202 into place flush against the base plate 116. With the skid steer mounting plate 202 just fitting within the area of the base plate 116 bounded by the perimeter walls projecting therefrom, the skid steer mounting plate the holes 124 in the bottom perimeter wall 118 align with downward depending vertical legs of inverted-J-shaped lock pin handles carried on the lift arm side of the skid steer mounting plate 202. The lock pin handles are operable to force their vertical legs downward from the skid steer mounting plate 202 through the holes 124 in the mounting unit's bottom perimeter wall 118 and lock in this position. This engagement of the pin handles through the holes of the mounting unit together with the positioning of the mounting plates upper edge between the mounting unit's base plate and sloped upper perimeter wall prevents withdrawal of the skid steer's mounting plate from the trenching attachment's mounting unit until the pin handles are disengaged.

In use, the trenching attachment 10 is secured to the skid steer 200 using the mounting unit 112. In the illustrated embodiment, the support plate 24 projects rearward further than the rest of the frame 12 so that the mounting unit 112 is positioned beneath a rear portion of the support plate 24, and so a notch or recess extends into the support plate 24 from the rear edge thereof to accommodate the attachment control linkage 206 of the skid steer mounted carried on and generally centrally between the lift arms 204 on opposite sides of the skid steer and connected to the skid steer mounting plate 202 to control pivoting thereof about a transverse horizontal axis extending between the lift arms 204 at the distal ends thereof. The hydraulic lines 60 are coupled to the auxiliary hydraulic system, or hydraulic power-take off system, of the skid steer to facilitate control over lifting and lowering of the attachment's boom 14 from the skid steers control panel. However, unlike conventional trenching attachments that rely on the power take-off system of the vehicle or working machine they are attached too, travel of the trenching chain 15 of the trenching attachment 10 around the boom 14 is powered entirely via the attachment's own dedicated engine 22, independently of any power system of the skid steer 200. The engine 22 can be started by operation of the starter switch 91*a*, with a throttle and choke control 126 of the engine 22 being operable in a conventional manner to assist in starting and control the engine speed. With the boom lowered closer to the ground, the clutch is engaged to initiate driving of the digging chain 15 via the drive belt 42. The boom is lowered into the earth by an amount chosen to define the desirable trench depth through operation of the skid steer's hydraulic controls to manipulate the hydraulic cylinder 48. With the throttle set to achieve a suitable trenching chain speed, the skid steer 200 is then used to pull the attachment rearward over the ground surface along a predetermined path to form the desired trench, as shown in FIG. 2.

A prototype of the trenching attachment was produced by significant modification of a commercially available self-propelling walk-behind trencher. The wheels, wheel driving system and associated controls were removed to reduce the frame or body length to provide a smaller non-self-propelled unit suitable for use as an attachment for a separate work machine. The existing boom arm assembly 14 and sprockets, digging chain 15, driven shaft assembly 18, auger 20, driven shaft gear box (i.e. gear casing 44 and the gear train therein), boom pivot assembly, chain guard 128, lift channel of the frame 12 and hydraulic lift cylinder 48 of the walk-behind unit remain in their originally installed configurations in the prototype. The prototype uses the clutch plate and spring rod assembly of the walk-behind trencher's existing belt tensioning clutch assembly used to start and stop its trenching chain, but with these elements repositioned and configured as described herein above to provide similar functions in the clutch assembly of the trenching attachment prototype. The prototype features an 18 hp Honda GX610 gasoline engine and has been used in combination with a Ditch Witch SK500 skid steer to provide excellent traction and digging performance.

It will be appreciated that the drawings and the foregoing description outlines only a single preferred embodiment of the trenching attachment. Numerous modifications are possible that would still result in a trenching attachment that is arranged for selective installation on a working machine without relying exclusively on an existing power system of that working machine to drive the digging chain. It will be appreciated that the attachment may make use of any of a number of internal combustion engines of varying sizes, displacements, configurations and power capabilities, for example to provide trenchers suitable for applications or working machines of varying types or scale, while still benefiting from reduced or eliminated dependence on a power take-off system of the working machine it is installed on. Furthermore, an internal combustion engine other than a gasoline engine, for example a diesel engine, could be used, or a gasoline engine using a battery charged during running of the engine as the spark plug power source could potentially be used in place of an engine featuring a magneto-based spark plug circuit. Different clutch types or alternate arrangements for coupling the engine output with the digging chain may be applied by those of skill in the art. Different frames of alternate shapes, sizes and structural configurations suitable for accommodating the internal combustion engine and trenching boom may be applied, and may optionally include wheels or tracks suitable for rolling of the attachment along the ground. Although the illustrated embodiment is and prototype are described for use with a walk-behind skid steer, trenching attachments adapted for attachment to other types of working machines could similarly benefit from reduced dependence on power take-off systems of such machines for operation of their digging chains in order to improve on the attachment's trenching performance.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A trenching attachment for selective attachment to a working machine, the trenching attachment comprising:

a frame arranged for selective connection to the working machine;

an internal combustion engine mounted to the frame;

a fuel tank carried on the frame and operably connected to the internal combustion engine to deliver fuel thereto;

an electric starter carried on the frame and operably connected to the internal combustion engine to effect starting thereof;

a battery power supply carried on the frame and coupled to the electric starter to provide power thereto for starting the engine;

a charging system associated with the engine and coupled to the battery power supply to effect charging thereof under operation of the engine;

a boom arm carried on the frame at a connection end of the boom arm and pivotal about a pivot axis transverse to the frame at the connection end of the boom arm;

an actuator carried on the frame and operable to effect pivoting of the boom arm to effect raising and lowering of a distal end of the boom arm opposite the connection end thereof relative to the frame;

a drive sprocket supported adjacent the connection end of the boom arm and rotatable about a rotational axis parallel to the pivot axis of the boom arm;

an idler sprocket supported on the boom adjacent a distal end thereof opposite the connection of the boom arm to the frame and rotatable about an idler axis parallel to the rotational axis of the drive socket;

a trencher chain entrained about the drive sprocket and idler sprockets;

a gear box having an input gear coupled to a belt driven sheave and an output gear coupled with a driven shaft extending along the pivot axis of the boom arm to effect rotation of the driven shaft under rotation of the output gear, the drive sprocket being coupled to the driven shaft to be rotationally driven thereby to operate the trencher train;

a belt driving sheave coupled to an output shaft of the engine for driven rotation thereby;

a belt closing around the belt driving sheave and the belt driven sheave;

a clutch installed on the frame and operable by an operator of the attachment to add and remove tension of belt around the belt driving and belt driven sheaves to selectively start and stop driven rotation of the belt driven sheave and the input and output gears of the gear box with the engine running; and a dead man's switch operable to cease operation of the trenching chain under a lack of input at the dead man's switch from the operator of the attachment, the dead man's switch being movable relative to the frame of the attachment and operable at a distance therefrom for enabling use of the dead man's switch from an operator position at the working machine.

2. The attachment according to claim 1 wherein the actuator is arranged for selective connection to the working machine for powering thereby.

3. The attachment according to claim 1 wherein the actuator comprises a hydraulic cylinder arranged for selective connection to a hydraulic system of the working machine for actuation thereby.

4. The attachment according to claim 1 in combination with the work machine, wherein the work machine is self-propelled, the attachment is releasably connected to the work machine for movement therewith along a ground surface and the internal combustion engine of the attachment is operable to drive the trenching chain.

5. The attachment according to claim 4 wherein the internal combustion engine of the attachment is operable to drive the trenching chain independently of any and all powering systems of the work machine.

6. The attachment according to claim 4 wherein driving of the trenching chain is powered solely by the internal combustion engine of the attachment.

7. The attachment according to claim 1 wherein the dead man's switch is carried on a flexible cord movable relative to the frame.

8. The attachment according to claim 4 wherein the actuator is releasably connected to a power take-off system of the working machine for selective powering thereby.

9. The attachment according to claim 4 wherein the actuator comprises a hydraulic actuator connected to a hydraulic system of the working machine for actuation thereby.

10. The attachment according to claim 4 wherein the dead man's switch is disposed at the operator position at the working machine.

11. The attachment according to claim 10 wherein the dead man's switch is releasably mounted to the work machine and connected to the attachment by a flexible cord.

12. The attachment according to claim 4 wherein the working machine is a mini skid steer.

13. The attachment according to claim 1 wherein the clutch comprises a pivotal assembly supported on the frame and pivotal between an engaged position adding the tension to the belt around the belt driving and belt driven sheaves and a disengaged position removing said tension from the belt.

14. The attachment according to claim 13 wherein the pivotal assembly is biased into the disengaged position and is selectively lockable in the engaged position by the operator.

15. The attachment according to claim 14 comprising an idler sheave rotatably carried on the pivoting assembly to selectively engage the belt to add the tension thereto, a lever fixed to the pivoting assembly to control positioning thereof, a plate having an elongated slot therein, a notch projecting laterally outward from the slot adjacent an end thereof and a spring biasing the pivoting assembly into the disengaged position, the lever being movable along the slot to move the pivotal assembly between the engaged position, in which the lever is received in the notch to lock the pivotal assembly in the engaged position, and the disengaged position in which the level is passes through the slot adjacent another end thereof opposite the notch.

16. The attachment according to claim 1 wherein the frame comprises a horizontal support plate disposed between opposing sides of the frame over a mounting arrangement where the frame is attachable to the work machine, the engine being mounted atop the horizontal support plate to extend the output shaft of the engine horizontally over the support plate toward one of the frame sides, the gearbox being supported at the side of the frame toward which the output shaft extends at an elevation below the support plate at distance from the mounting arrangement to a side thereof opposite that from which the mounting arrangement is to be engaged by the working machine, the belt sloping downward past the mounting plate from the belt driving sheave coupled to the output shaft of the engine above the mounting plate to the belt driven sheave coupled to the input gear of the gear box below the mounting plate, and the driven shaft projecting horizontally from the output gear of the gearbox toward the side of the frame thereopposite to couple with the drive sprocket for driven operation of the trenching chain at a position between the opposing sides of the frame and adjacent an end of the housing opposite the mounting arrangement.

17. The attachment according to claim 16 comprising an auger rotatably driven by the driven shaft and disposed on a side of the boom arm and the drive sprocket opposite the gear box, wherein the actuator is coupled to the boom arm from a side thereof opposite the auger.

18. The attachment according to claim 16 wherein the actuator has an upper end pivotally supported above the support plate, the actuator sloping downward past the supporting plate to a lower end of the actuator that is coupled to the boom arm at a position therealong radially outward from the pivot axis.

19. The attachment according to claim 16 wherein the actuator is disposed between the engine and the belt in a transverse direction along which the opposing sides of the frame are spaced apart.

20. The attachment according to claim 1 wherein the clutch comprises a lever supported on the frame and movable by the operator of the attachment to control the clutch.

* * * * *